US008674619B2

(12) United States Patent
Nakamori et al.

(10) Patent No.: US 8,674,619 B2
(45) Date of Patent: Mar. 18, 2014

(54) HIGH FREQUENCY POWER SUPPLY DEVICE

(75) Inventors: Yuya Nakamori, Osaka (JP); Tatsuya Ikenari, Osaka (JP); Daisuke Maehara, Osaka (JP); Masao Umehara, Osaka (JP); Satoru Hamaishi, Osaka (JP)

(73) Assignee: Daihen Corporation, Osaka (JP)

( * ) Notice: Subject to any disclaimer, the term of this patent is extended or adjusted under 35 U.S.C. 154(b) by 0 days.

(21) Appl. No.: 13/603,556

(22) Filed: Sep. 5, 2012

(65) Prior Publication Data

US 2013/0082620 A1 Apr. 4, 2013

(30) Foreign Application Priority Data

Sep. 30, 2011 (JP) ..... 2011-217628

(51) Int. Cl.
*H05B 41/24* (2006.01)

(52) U.S. Cl.
USPC ..... 315/246; 315/248

(58) Field of Classification Search
None
See application file for complete search history.

(56) References Cited

U.S. PATENT DOCUMENTS

| | | | | |
|---|---|---|---|---|
| 6,495,972 | B1 * | 12/2002 | Okamoto et al. | 315/291 |
| 7,221,102 | B2 * | 5/2007 | Kotani et al. | 315/248 |
| 7,847,489 | B2 * | 12/2010 | Lin | 315/291 |
| 2009/0322254 | A1 * | 12/2009 | Lin | 315/307 |
| 2010/0141153 | A1 * | 6/2010 | Recker et al. | 315/149 |
| 2010/0327766 | A1 * | 12/2010 | Recker et al. | 315/291 |
| 2011/0133655 | A1 * | 6/2011 | Recker et al. | 315/159 |

FOREIGN PATENT DOCUMENTS

JP 2009-238516 10/2009

* cited by examiner

*Primary Examiner* — Crystal L Hammond
(74) *Attorney, Agent, or Firm* — Greenblum & Bernstein, P.L.C.

(57) ABSTRACT

A high frequency power supply device includes a high frequency power generation unit configured to output a high frequency power to be supplied to a load and a control unit configured to detect a mean value of the high frequency power to control the high frequency power generation unit. A power change period detection unit detects a period of a level change of the high frequency power that is detected at an output side of the high frequency power generation unit due to a periodic change of a level of a high frequency power that is given to a load from another high frequency power supply device as a power change period $T_Z$. A control period setting unit sets a control period $T_C$ to an appropriate value in accordance with the power change period $T_Z$ detected by the power change period detection unit.

12 Claims, 8 Drawing Sheets

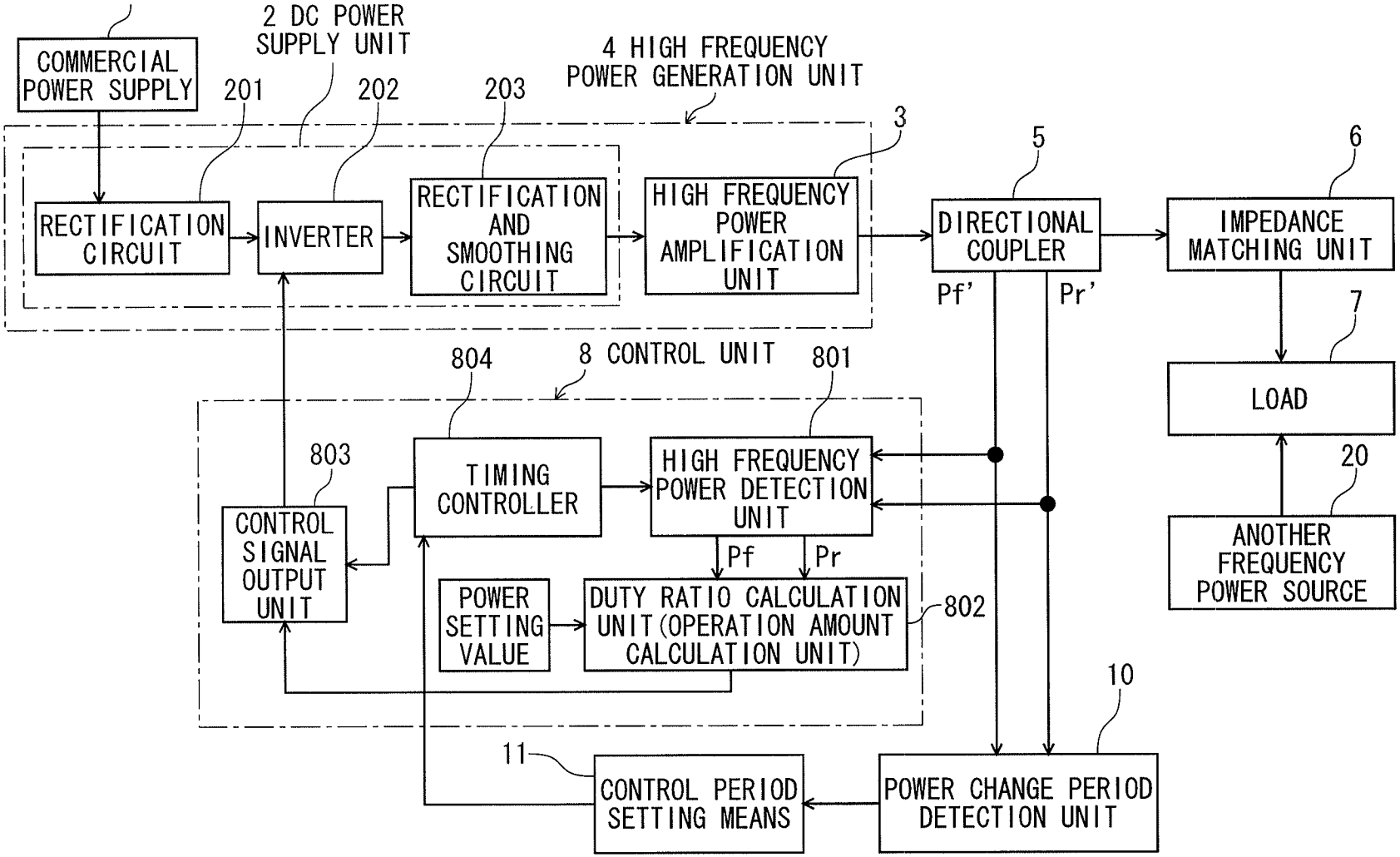
FIG. 1
1
COMMERCIAL POWER SUPPLY
2 DC POWER SUPPLY UNIT
201
RECTIFICATION CIRCUIT
202
INVERTER
203
RECTIFICATION AND SMOOTHING CIRCUIT
4 HIGH FREQUENCY POWER GENERATION UNIT
3
HIGH FREQUENCY POWER AMPLIFICATION UNIT
5
DIRECTIONAL COUPLER
Pf'
Pr'
6
IMPEDANCE MATCHING UNIT
7
LOAD
20
ANOTHER FREQUENCY POWER SOURCE
8 CONTROL UNIT
801
HIGH FREQUENCY POWER DETECTION UNIT
Pf
Pr
802
DUTY RATIO CALCULATION UNIT (OPERATION AMOUNT CALCULATION UNIT)
803
CONTROL SIGNAL OUTPUT UNIT
804
TIMING CONTROLLER
POWER SETTING VALUE
10
POWER CHANGE PERIOD DETECTION UNIT
11
CONTROL PERIOD SETTING MEANS Po:MEAN VALUE OF HIGH FREQUENCY POWER AT OUTPUT END OF HIGH FREQUENCY POWER SUPPLY DEVICE
Tc:CONTROL PERIOD
Tz:POWER LEVEL CHANGE PERIOD DUE TO LEVEL CHANGE OF OUTPUT OF ANOTHER HIGH FREQUENCY POWER SOURCE

HIGH FREQUENCY POWER SUPPLY DEVICE

The disclosure of Japanese Patent Application No. 2011-217628 filed on Sep. 30, 2011, including specification, drawings and claims is incorporated herein by reference in its entirety.

TECHNICAL FIELD

The present invention relates to a high frequency power supply device which is suitable to supply a high frequency power to a plasma load of a plasma processing device or the like that performs processes of thin film formation, surface reforming, or thin film removal (etching or ashing) using plasma with respect to a semiconductor or liquid crystals.

BACKGROUND

A high frequency power supply device that supplies a high frequency power to a plasma load or the like, for example, as disclosed in Patent Literature 1, includes a DC power supply unit that can control an output by a predetermined amount of operation (for example, a duty ratio of PWM control performed by a DC/DC converter), a high frequency power generation unit having a high frequency power amplification unit which generates a high frequency power that is supplied to a load using an output voltage of the DC power supply unit as a power supply voltage, and a control unit controlling the high frequency power generation unit.

The DC power supply unit includes, for example, a rectification circuit (converter) converting an output of a commercial power supply into a DC output, an inverter converting an output of the rectification circuit into an AC voltage, and a DC/DC converter having a rectification and smoothing circuit rectifying and smoothing an output of the inverter.

The high frequency power amplification unit includes a power amplifier amplifying a high frequency signal using the output voltage of the DC power supply unit as a power supply voltage, and an inverter converting the output of the DC power supply unit into a high frequency output. The high frequency power that is obtained from the high frequency power generation unit that is composed of the DC power supply unit and the high frequency power amplification unit is supplied, as needed, to a load such as a plasma load through an impedance matching unit.

The control unit that controls the high frequency power generation unit includes a high frequency power detection unit detecting a level of the high frequency power at an output side of the high frequency power generation unit in each detection timing, which is a timing that comes in each set control period, in order to obtain the high frequency power that is targeted for control in each control period, and detecting a moving mean value that is calculated from n (n is an integer that is equal to or larger than 2) detection data detected in recent n detection timings as a mean value of the high frequency power that is targeted; an operation amount calculation unit setting a size of a variable for determining a level of the high frequency power output from the high frequency power generation unit as an operation amount of the high frequency power generation unit and calculating the operation amount that is needed to keep the mean value of the high frequency power that is targeted for control and detected by the high frequency power detection unit to a setting value; and a control signal output unit outputting in each control period a control signal that is given to the high frequency power generation unit in order to take the operation amount of the high frequency power generation unit as the operation amount calculated by the operation amount calculation unit.

The operation amount of the high frequency power generation unit is a variable that determines the output of the DC power supply unit or a gain of the power amplifier that constitutes the high frequency power amplification unit 3. For example, in the case where the DC power supply unit is composed of the DC/DC converter having the above-described configuration, the duty ratio of the PWM control of the inverter that converts the output of the rectification circuit into the AC voltage may be the operation amount.

In the case of performing a control for keeping the output of the high frequency power supply device to the setting value, a control to keep the level (instantaneous value) of the high frequency power, which is detected in the control period and is targeted for control, to the setting value is not performed, but a control to detect the mean value of the output level of the high frequency power supply device and to keep the mean value to the setting value is performed. As a method for this, a method for controlling the high frequency power generation unit is used so as to detect the level of the high frequency power that is targeted for control in each control period, to consider the moving mean value of the level of the high frequency power obtained from the recent detection data as the mean value of the high frequency power, and to keep this mean value to the setting value.

In a plasma processing device that performs various kinds of processes using plasma with respect to a work piece such as a semiconductor or liquid crystals, plasma is generated by applying high frequency power between electrodes installed in a process chamber, and a high frequency power supply device for giving a bias power to the plasma is needed to perform various kinds of control such as control of ion energy or the like in addition to the high frequency power for generating the plasma from the need of planning miniaturization and speedup of the processing. The high frequency power supply device for supplying the high frequency power for generating the plasma and the high frequency power supply device for supplying the high frequency power for bias have different frequencies. The output frequency of the high frequency power for generating the high frequency power for generating the plasma is, for example, in the frequency range neighboring several tens to several hundreds of MHz, and the output frequency of the high frequency power for generating the high frequency power for bias is in the relatively low frequency range of several tens of kHz to several MHz. In Patent Literature 1, as illustrated in FIG. 7, a power supply system for supplying power from first and second high frequency power supply devices A and B having different output frequencies to a plasma load C is described.

The power supply system for supplying a high frequency power to a load such as the plasma load C may supply a high frequency power having a non-modulated consecutive voltage waveform to the load C or may supply a high frequency power having a modulated voltage waveform through a pulse waveform by a demand of the load side.

Patent Literature 1: Japanese Patent Application Publication No. 2009-238516A

In the system in which the first high frequency power supply device A and the second high frequency power supply device B are installed as illustrated in FIG. 7 to simultaneously supply the power to the plasma load C, a high frequency power of approximately a constant level, of which the output frequency is f1 (for example, f1=3.2 MHz) and of which the voltage V1 forms a consecutive waveform (non-modulated waveform), may be supplied from the first high frequency power supply device A to the plasma load C as illustrated in FIG. 8A, and a high frequency power, of which the output frequency is f2 (for example, f2=60 MHz) and of which the level of the voltage V1 is changed in each period T3 (f=1/f3) since the high frequency power has been modulated into a pulse waveform having the frequency f3 (for example, f3=10 kHz to 90 kHz), may be supplied from the second high frequency power supply device B to the plasma load C as illustrated in FIG. 8B. In this case, fluctuation (slow level change of the low frequency) may occur in the mean value of the output of the first high frequency power supply device A that outputs the high frequency power of the consecutive waveform.

In the power supply system illustrated in FIG. 7, the high frequency power of the consecutive waveform (non-modulated waveform) may be supplied from the first high frequency power supply device A to the plasma load C, and the pulse-modulated high frequency power may be supplied from the second high frequency power supply device B to the plasma load C. In this case, if the modulated frequency of the high frequency power that is given from the second high frequency power supply device B to the plasma load C is changed, the accuracy of output control for keeping the output of the first high frequency power supply device A to the setting value may deteriorate.

In order to perform fine processing of a semiconductor or the like at high accuracy, it is needed to perform the control for keeping the mean value of the high frequency power that is supplied to the plasma load to the setting value at high accuracy, and thus it is needed to avoid change of the high frequency power (mean value) that is supplied to the load or deterioration of the accuracy of the output control as much as possible.

The high frequency power supply device according to the present invention is, as illustrated in FIG. 7, a high frequency power supply device that generates a high frequency power of the consecutive waveform (non-modulated waveform) among a plurality of high frequency power supply devices that simultaneously supply the high frequency powers to the load C.

SUMMARY

It is thereof an object of the present invention to prevent fluctuation from occurring in the mean value of the high frequency power that is targeted for control and to prevent the accuracy of the output control from deteriorating through performing of the output control for constantly keeping the average value of the high frequency power that is detected from the output side and is targeted for control in the case where the high frequency power that is modulated by a pulse waveform or the like is supplied from another high frequency power supply device to the load in a high frequency power supply device that supplies the high frequency power of the consecutive waveform having a constant mean value to the load.

The present invention relates to a high frequency power supply device including a high frequency power generation unit configured to output a high frequency power to be supplied to a load, and a control unit configured to detect a mean value of the high frequency power that is targeted for control at an output side of the high frequency power generation unit, and to control the high frequency power generation unit so as to keep the detected mean value of the high frequency power to a setting value.

In the high frequency power supply device according to the present invention, the control unit includes: a high frequency power detection unit configured to obtain detection data of a level of the high frequency power, that is needed to be targeted for detection in order to obtain the high frequency power that is targeted for control at a timing that comes in each control period Tc as a detection timing, to obtain a moving mean value of the high frequency power that is targeted for detection from n detection data (n is an integer that is equal to or larger than 2) obtained at recent n detection timings, and to detect the mean value of the high frequency power that is targeted for control by setting the moving mean value as a mean value of the high frequency power, that is targeted for detection; an operation amount calculation unit configured to set a size of a variable for determining a level of the high frequency power output from the high frequency power generation unit as an operation amount of the high frequency power generation unit and to calculate the operation amount which is needed to keep the mean value of the high frequency power that is targeted for control and is detected by the high frequency power detection unit to the setting value; and a control signal output unit configured to output in the each control period a control signal to be given to the high frequency power generation unit to the operation amount that is calculated by the operation amount calculation unit.

According to the present invention, a power change period detection unit is configured to detect a period of a level change of the high frequency power that is detected at the output side of the high frequency power generation unit due to a periodic change of a level of a high frequency power that is given to the load from another high frequency power supply device as a power change period Tz, and a control period setting unit is configured to set the control period Tc to an appropriate value in accordance with the power change period Tz detected by the power change period detection unit.

According to the present invention, the high frequency power that is targeted for control may be a traveling-wave power or an effective power that is obtained by subtracting a reflection-wave power from the traveling-wave power. The high frequency power that is targeted for detection is determined depending on the high frequency power that is targeted for control. In a case where the effective power is targeted for control, both the traveling-wave power and the reflection-wave power are targeted for detection, while in a case where the traveling-wave power is targeted for control, only the traveling-wave power is targeted for detection.

In a case where the high frequency power having the consecutive waveform is supplied from the high frequency power supply device to the load, if the high frequency power, of which the level is periodically changed due to the modulation of the high frequency power through a pulse waveform or the like, is applied from another high frequency power supply device to the load, a periodic level change occurs in the high frequency power that is detected at the output side of the high frequency power supply device that outputs the high frequency power having the consecutive waveform. As described above, in a case where the periodic level change occurs in the high frequency power that is detected at the output side of the high frequency power supply device, fluctuation may occur in the output of the high frequency power generation device that outputs the high frequency power having the consecutive waveform (non-modulated waveform) unless the control period has an appropriate value with respect to the period of the level change (power change period). This state occurs when a difference between the control period and the power change period is a slight difference. In the high frequency power supply device in the related art, since the control period is set to be constant, if the modulated frequency of the high frequency power that is supplied from another high frequency power supply device to the load is changed so that the value of the control period Tc occasionally approaches the value of the power change period Tz by chance when the period Tz of the level change, which occurs in the high frequency power detected from the output side of the high frequency power generation unit, is changed, the fluctuation may occur in the output of the high frequency power generation unit.

According to the present invention, since the power change period detection unit is configured to detect the period of the level change of the high frequency power that is detected at the output side of the high frequency power generation unit due to the periodic change of the level of the high frequency power given from another high frequency power supply device to the load as the power change period Tz, and the control period setting unit is configured to set the control period Tc to the appropriate value in accordance with the detected power change period Tz, the control period Tc can be set to the appropriate value with respect to the power change period Tz, and the control period and the power change period are prevented from approaching each other. Accordingly, the fluctuation can be prevented from occurring in the output of the high frequency power generation device that outputs the high frequency power having the consecutive waveform. Further, since the control period can be set so as to reduce an error between the moving mean value of the high frequency power detected by the high frequency power detection unit and a true mean value, the accuracy of the output control can be prevented from deteriorating. In the description, the "appropriate value" of the control period does not mean a sole value, but means values that are included in an appropriate range in which the error between the moving mean value of the high frequency power and the true mean value can be kept within a permissible range.

The appropriate value of the control period Tc can be accurately set by paying attention to the relationship between the number ns of data (the number of necessary data) that are needed to calculate an arithmetic mean value and the number n of detection data that are used to calculate the moving mean value or by paying attention to the relationship between a time ns×Tc that is needed to obtain the detection data the number of which is equal to the number ns of data that are needed to calculate the arithmetic mean value and a time n×Tc that is required to acquire n detection data used to calculate the moving mean value.

The number ns of data (the number of necessary data), which is needed to detect the level of the high frequency power that is varied in the power change period Tz in each control period Tc and to calculate the arithmetic mean value through k cycles of the level change of the high frequency power, can be obtained by an equation $ns=k\times\{Tz/|m\cdot Tz-Tc|\}$ (where, m is an integer that is equal to or larger than 1, and $mTz\neq Tc$).

In order to precisely perform the output control, it is needed to reduce the difference between the moving mean value of the high frequency power detected by the high frequency detection unit and a true mean value (arithmetic mean value) as much as possible. In the case of calculating the moving mean value of the high frequency power from the n detection data through detection of the level of the high frequency of which the level is varied in the power change period Tz, it is preferable that the number ns of necessary data that is calculated by the above-described equation coincides with the number n of detection data that are used to calculate the moving mean value (n=ns) or the difference between n and ns is small in order to reduce the error between the moving mean value and the true mean value. Further, in order to reduce the error between the moving mean value and the true mean value, it is preferable that the difference between the time n×Tc that is required to calculate the moving mean value and the time ns×Tc that is needed to obtain the ns detection data.

As is clear from the above-described equation, in order to correctly calculate the arithmetic mean value of the level change of k cycles of the high frequency power, the number ns of detection data that are needed to acquire with respect to the waveform of the k cycles of the level change of the high frequency power (in the voltage change period Tz) becomes a function of the control period Tc and the power change period Tz, and thus the value of the control period Tc that satisfies the equation of n×Tc=ns×Tc is changed according to the change of the value of the power change period Tz. Accordingly, in order to reduce the error between the moving mean value and the true mean value, it is needed to set the value of the control period Tc to an appropriate value according to the value of the power change period Tz. Further, the control period Tc affects the control characteristic of the output control to keep the mean value of the output of the high frequency power generation unit to the setting value, and thus it is needed to set the value of the control period Tc to a value within the permissible range of the output control.

Accordingly, in a preferred aspect of the present invention, the control period setting means sets the value of the control period to an appropriate value that is a value in the range in which the error which occurs between the moving mean value of the high frequency power that is calculated using the n detection data and a true mean value of the high frequency power can be kept in the permissible range and a time that is needed to obtain the n detection data can be kept equal to or below an upper limit time that is permitted in controlling the high frequency power generation unit.

In another aspect of the present invention, the control period setting means sets an appropriate value of the control period according to the power change period detected by the power change period detection unit so that the high frequency power detection unit sets the time n×Tc that is required to obtain the recent n detection data that are used to calculate the moving mean value to the time in which the error that occurs between the moving mean value of the high frequency power calculated using the n detection data and a true mean value of the high frequency power can be kept within a permissible range.

In still another aspect of the present invention, the control period setting means sets an appropriate value of the control period so that the high frequency power detection unit sets a time different $\Delta T$ ($=Tc\times|n-ns|$) between the time n×Tc that is required to obtain the recent n detection data that are used to calculate the moving mean value and the time ns×Tc that is required to obtain ns detection data that are needed to calculate an arithmetic mean value of level change of k (k is an integer that is equal to or larger than 1) cycles of the high frequency power using the detection data that is obtained by detecting the level of the high frequency power, of which the level is changed in the power change period Tz (where, $m\cdot Tz\neq Tc$, m is an integer that is equal to or larger than 1), in each control period Tc, to a time difference in a range in which an error that occurs between the moving mean value of the high frequency power calculated using the n detection data and a true mean value of the high frequency power can be kept within a permissible range.

In still another aspect of the present invention, the control period setting means sets an appropriate value of the control period so that the high frequency power detection unit keeps a time different $\Delta T$ ($=Tc\times|n-ns|$) between the time n×Tc that is required to obtain the recent n detection data that are used to calculate the moving mean value and the time ns×Tc that is required to obtain ns detection data that are needed to calculate an arithmetic mean value of level change of k (k is an integer that is equal to or larger than 1) cycles of the high frequency power using the detection data that is obtained by detecting the level of the high frequency power, of which the level is changed in the power change period Tz (where, $Tz \neq Tc$), in each control period Tc, within a permissible range.

In still another aspect of the present invention, the control period setting means sets an appropriate value of the control period so that the high frequency power detection unit minimizes a time different $\Delta T$ ($=Tc \times |n-ns|$) between the time $n \times Tc$ that is required to obtain the recent n detection data that are used to calculate the moving mean value and the time $ns \times Tc$ that is required to obtain ns detection data that are needed to calculate an arithmetic mean value of level change of k (k is an integer that is equal to or larger than 1) cycles of the high frequency power using the detection data that is obtained by detecting the level of the high frequency power, of which the level is changed in the power change period Tz (where, $Tz \neq Tc$), in each control period Tc.

If the control period setting means are configured and the appropriate value of the control period is set with respect to the power change period as described above according to the respective aspects, the error between the moving mean value of the high frequency power detected by the high frequency power detection unit and the true mean value can be decreased. Accordingly, the moving mean value of the high frequency power is changed to lean toward the upper side or lower side of the true average value, and thus the accuracy of the output control is prevented from deteriorating due to the fluctuation occurring in the output of the high frequency power generation unit or the increase of the error occurring between the moving means value detected by the high frequency power detection unit and the true mean value.

According to still another aspect of the present invention, the control period setting means is configured to calculate the appropriate value of the control period using a map that gives a relationship between the detected power change period and the control period.

According to still another aspect of the present invention, the control period setting means is configured to set the appropriate value of the control period within a range of values that can be taken by the control period in the output control of the high frequency power generation unit.

According to still another aspect of the present invention, the control period setting means is configured to change the control period within the range of values that can be taken by the control period with the lapse of time if the appropriate value of the control period is not present in the range of values that can be taken by the control period.

As described above, by making the control period changed within the set range with the lapse of time if the appropriate value of the control period is not present in the set range, the n detection data that the high frequency detection unit uses to calculate the moving mean value can be prevented from being composed of a data group obtained by detecting only the levels of parts of level change waveforms of k cycles of the high frequency power, and thus the detection data obtained by detecting the levels of the respective parts of the level change waveforms of the k cycles without exception. Accordingly, the error between the moving mean value detected by the high frequency power detection unit and the true mean value can be reduced.

According to still another aspect of the present invention, the number ns of data that are needed to calculate the arithmetic mean value of the level change of the k cycles (k is an integer that is equal to or larger than 1) of the high frequency power is calculated by an equation $ns=k \times \{Tz/|m \cdot Tz-Tc|\}$ (where, m is an integer that is equal to or larger than 1, and $mTz \neq Tc$).

As described above, according to the present invention, since the period of the level change which occurs in the high frequency power detected at the output end of the high frequency power generation unit that outputs the high frequency power of the consecutive waveform is detected as the power change period through the periodic level change of the high frequency power that is given from another high frequency power supply device to the load, and the appropriate value of the control period is set with respect to the detected power change period. Accordingly, the value of the control period is set so as to prevent the occurrence of alternate repetition of a state where the moving mean value detected by the high frequency power detection unit that performs the output control leans toward the upper side of the true mean value and a state where the moving mean value leans toward the lower side of the true mean value, and thus the fluctuation can be prevented from occurring in the output of the high frequency power generation device that outputs the high frequency power having the consecutive waveform. Further, according to the present invention, since the control period can be set to reduce the error between the moving mean value detected by the high frequency power detection unit and the true mean value, the accuracy of the output control is prevented from deteriorating.

BRIEF DESCRIPTION OF THE DRAWINGS

FIG. 1 is a block diagram schematically illustrating the configuration of a high frequency power supply device according to an embodiment of the present invention.

DETAILED DESCRIPTION OF THE EMBODIMENTS

Figure 2:
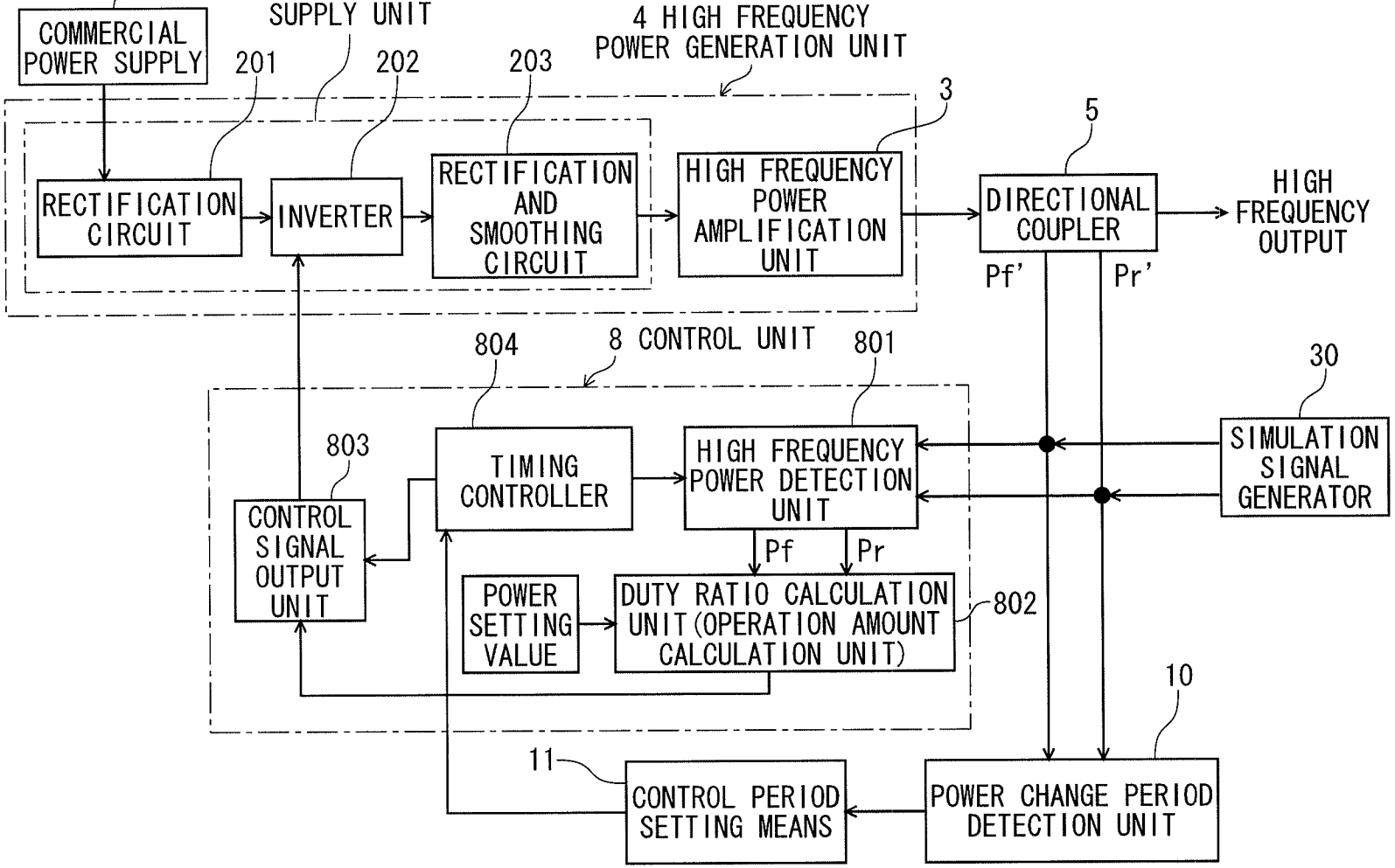
FIG. 2 is a block diagram illustrating a state where a simulated signal is input to simulate a state where another high frequency power supply device affects the high frequency power supply device illustrated in FIG. 1.

Hereinafter, illustrative embodiments of the invention will be specifically described with reference to the accompanying drawings.

FIG. 1 is a block diagram schematically illustrating the configuration of a high frequency power supply device according to an embodiment of the present invention. In the drawing, 1 denotes a commercial power supply, 2 denotes a DC power supply unit which converts an output of the commercial power supply 1 into a DC output and of which the output level is variable, and 3 denotes a high frequency power amplification unit which amplifies a high frequency signal having the same frequency as the frequency of the high frequency power that is supplied to a load using the DC voltage obtained from the DC power supply unit 2 as a power supply voltage and outputs the high frequency power. The DC power supply unit 2 and the high frequency power amplification unit 3 constitute a high frequency power generation unit 4 that generates the high frequency power that is supplied to a load.

As illustrated, the DC power supply unit 2 includes a rectification circuit 201 rectifying an AC voltage obtained from the commercial power supply 1, an inverter 202 converting an output of the rectification circuit 201 into an AC output, and a rectification and smoothing circuit 203 rectifying and smoothing an output of the inverter 202.

Figure 3:
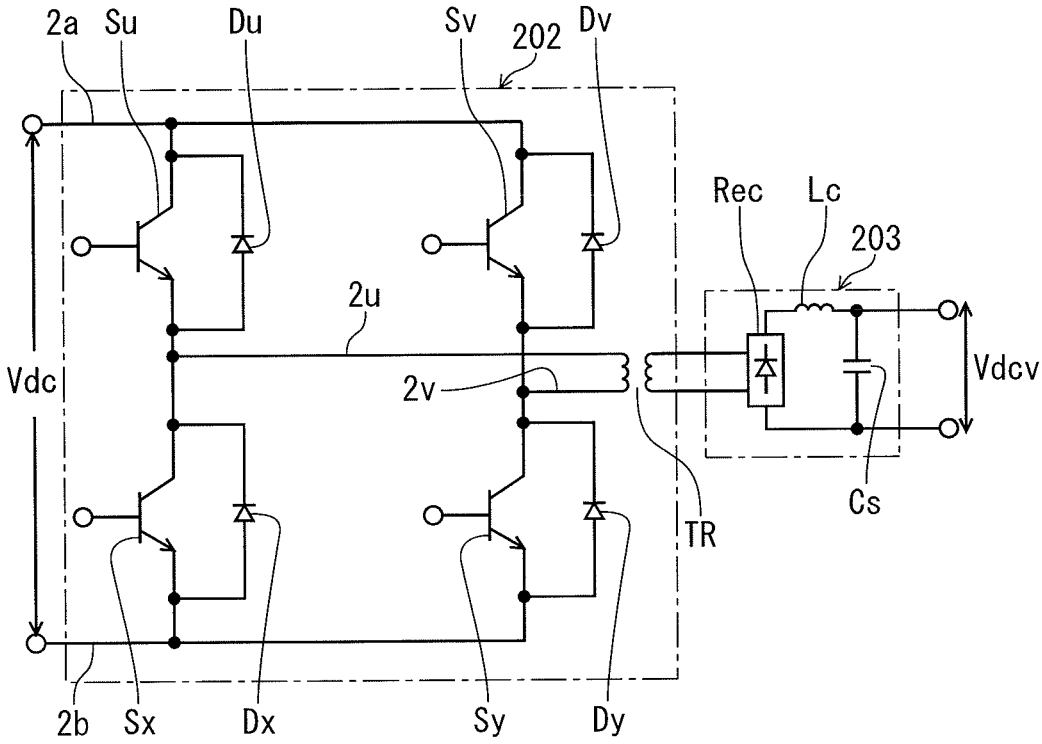
FIG. 3 is a circuit diagram illustrating a configuration example of a DC power supply unit that is installed in the high frequency power generation unit of the high frequency power supply device illustrated in FIG. 1.

As illustrated in FIG. 3, the inverter 202 includes a full-bridge type switch circuit having an upper stage of a bridge composed of semiconductor switch elements Su and Sv each having one end commonly connected to be on/off controlled and return diodes Du and Dv connected in reverse parallel to the switch elements Su and Sv, and a lower state of the bridge composed of switch elements Sx and Sy each having one end connected to the other end of the switch elements Su and Sv and the other end commonly connected and return diodes Dx and Dy connected in reverse parallel to the switch elements Sx and Sy, and an output transducer TR having a primary coil connected between AC output ends 2*u* and 2*v* of the switch circuit derived from a connection point of the switch elements Su and Sx and a connection point of the switch elements Sv and Sy. In the illustrated inverter, input terminals 2*a* and 2*b* are derived from a common connection point of the switch elements Su and Sv and a common connection point of the switch elements Sx and Sy, and a DC voltage Vdc that is output from a rectification circuit 201 is input between the input terminals.

The inverter 202 illustrated in FIG. 3 converts the DC voltage Vdc into an AC voltage by alternately turning on the switch elements Su and Sy and the switch elements Sv and Sx that are at diagonal positions. Further, by performing an on/off control of the switch elements Su and Sv constituting the upper stage of the bridge and the switch elements Sx and Sy constituting the lower stage of the bridge of the same inverter in a predetermined duty ratio, the output of the inverter 202 is PWM-controlled. By changing the duty ratio of this PWM control as an operation amount, the output of the inverter 202 can be properly changed.

The rectification and smoothing circuit 203 includes, for example, as illustrated in FIG. 3, a rectifier Rec rectifying the AC output of the inverter obtained from a secondary side of the transducer TR, and a smoothing capacitor Cs connected between the output terminals of the rectifier Rec through a chock coil Lc, and outputs a DC voltage Vdc at both ends of the smoothing capacitor Cs.

The high frequency power amplification unit 3 is composed of an amplification circuit having power MOSFETs or bipolar power transistors as amplification elements. The high frequency power amplification unit 3 amplifies a high frequency signal that is obtained from a high frequency signal source (not illustrated) that generates the high frequency signal having the same frequency as the high frequency power that is supplied to the load, and outputs the high frequency power having a predetermined frequency. In this embodiment, the high frequency power amplification unit 3 changes the output value of the high frequency power output from the high frequency power generation unit 4 by adjusting the output voltage of the DC power supply unit 2 (power supply voltage of the high frequency power amplification unit 3) through changing of the duty ratio of the PWM control of the inverter 202 as an operation amount.

The high frequency power output from the high frequency power generation unit 4 is supplied to a load 7 such as a plasma load through a low-pass filter (not illustrated) that passes only the basic frequency component of the high frequency power, a directional coupler 5, an impedance matching unit 6, and a transmission line having a characteristic impedance of 50. The directional coupler 5 branches and outputs a part Pf' of a traveling-wave power that is supplied from the high frequency power generation unit 4 to the load 7 and a part Pr' of a reflection-wave power that is reflected by and returns from the load 7 when the impedance matching unit 6 is unable to completely take impedance matching.

A control unit 8 is installed to control the output of the high frequency power generation unit 4. The illustrated control unit 8 includes a high frequency power detection unit 801, a duty ratio calculation unit (operation amount calculation unit) 802, a control signal output unit 803, and a timing controller 804 controlling the timing in which the high frequency power detection unit 801 performs the detection operation and the timing in which the control signal output unit 803 outputs the control signal.

The high frequency power detection unit 801 detects a level of the high frequency power that is targeted for detection from an output of the directional coupler 5 on the output side of the high frequency power generation unit 4 in the detection timing which is the timing that comes in each set control period, obtains a moving mean value that is calculated from n detection data detected in recent n (n is an integer that is equal to or larger than 2) detection timings including this coming detection timing as a mean value of the high frequency power that is targeted for detection, and detects the mean value of the high frequency power that is targeted for control from the mean value of the high frequency power that is targeted for detection. The number n of detection data that the high frequency power detection unit 801 uses to calculate the moving mean value is an integer that is equal to or larger than 2, and is set as an appropriate value in advance in consideration of the control characteristics of the output control. In the case of obtaining the detection data in each control period Tc, a time of n×Tc is needed to obtain the predetermined number n of detection data.

The duty ratio calculation unit (operation amount calculation unit) 802 set the size of a variable for determining the level of the high frequency power output from the high frequency power generation unit as an operation amount of the high frequency power generation unit and calculates the operation amount that is needed to keep the mean value of the high frequency power that is targeted for control and detected by the high frequency power detection unit to a setting value.

The control signal output unit 803 outputs in each set control period a control signal that is given to the high frequency power generation unit in order to take the operation amount of the high frequency power generation unit 4 as the operation amount calculated by the operation amount calculation unit 802.

The operation amount of the high frequency power generation unit 4 may be a variable or a variable rate that determines the size of the high frequency power that is output from the high frequency power generation unit 4. In the case where the high frequency power generation unit 4 is composed of the DC power supply unit 2 and the high frequency power amplification unit 3, the variable rate that determines the output of the high frequency DC power supply unit or the gain of the high frequency power amplification unit 3 can be considered as the operation amount of the high frequency power generation unit. For example, like this embodiment, if the DC power supply unit 2 includes a rectification circuit 201 rectifying an AC output of the commercial power supply into a DC output, an inverter 202 converting an output of the rectification circuit 201 into an AC output, and a rectification and smoothing circuit 203 rectifying and smoothing an output of the inverter 202, and is configured to adjust the output of the high frequency power amplification unit 3 by adjusting the DC output voltage through PWM control of the inverter 202, the duty ratio of the PWM control can be considered as the operation amount of the high frequency power generation unit 4.

In this case, the operation amount calculation unit 802 calculates the duty ratio of the PWM control of the inverter, which is needed to keep the mean value of the high frequency power that is targeted for control and detected by the high frequency power detection unit 801 to the setting value, as the operation amount, and the control signal output unit 803 outputs in each set control period the control signal given to the inverter 202 (a signal for turning on/off the switch elements constituting the inverter) in order to perform the PWM control of the inverter 202 with a calculated duty ratio.

In this embodiment, the duty ratio of the PWM control of the inverter 202 that determines the output voltage of the DC power supply unit 2 is considered as the operation amount of the high frequency power generation unit, and the effective power that is obtained by subtracting the reflection-wave power Pr from the traveling-wave power Pf is considered as the high frequency power that is targeted for control. Accordingly, the high frequency power detection unit 801 sets both the traveling-wave power Pf and the reflection-wave power Pr as the targets for detection, detects the moving mean values of respective powers in each control period, and obtains the moving mean value of the effective power that is targeted for control through subtraction of the moving mean value of the reflection-wave power from the moving mean value of the traveling-wave power Pf.

In order to perform PWM control of the output of the inverter 202 of the DC power supply unit 2 with the calculated duty ration, the control signal output unit 803 gives the control signal for intermitting the output of the inverter 202 with the calculated duty ratio to the control terminals of the switch elements Su and Sv at the upper stage of the bridge and the switch elements Sx and Sy of the lower stage of the bridge of the inverter 202. Accordingly, through adjustment of the output voltage of the DC power supply unit 2, the high frequency power having the same mean value of the setting value is output from the high frequency power amplification unit 3.

In the case where the traveling-wave power Pf that is given from the high frequency power generation unit 4 to the load is targeted for control, it is not necessary for the high frequency power detection unit 801 to detect the reflection-wave power Pr.

The timing controller 804 controls the timing in which the high frequency power detection unit 801 performs detection operation and the timing in which the control signal output unit 803 outputs the control signal.

Figure 7:
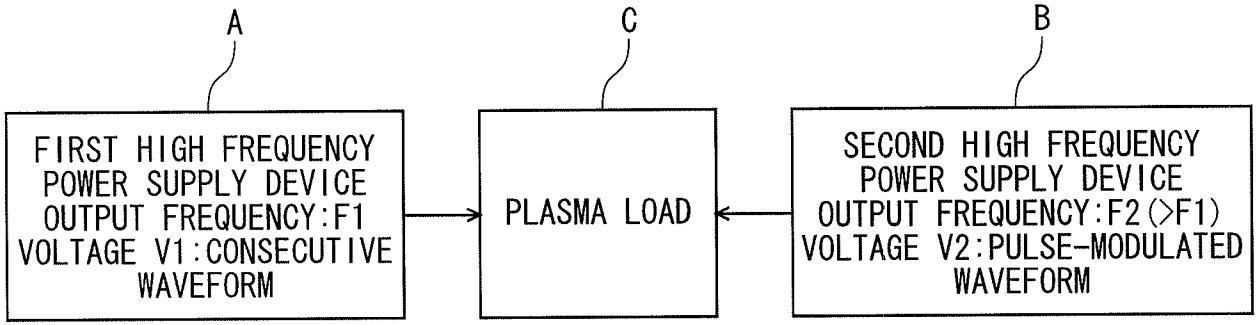
FIG. 7 is a block diagram illustrating a state where two different high frequency power supply devices having two different output frequencies and voltage waveforms supply high frequency powers to a plasma load.

As illustrated in FIG. 7, the inventor installed a first high frequency power supply device A and a second high frequency power supply device B and performed various analysis with respect to a power supply system for simultaneously supplying power from the high frequency power supply devices to a plasma load C to clarify the following points.

(a) If the high frequency power, of which the level is periodically changed due to the modulation of the high frequency power through a pulse waveform or the like, is supplied from the second high frequency power supply device B to the load C in the case where the high frequency power of the consecutive waveform having approximately a constant mean value is supplied from the first high frequency power supply device A to the load C, a periodic level change occurs in the traveling-wave power and the reflection-wave power that that is detected from the high frequency power detection unit of the first high frequency power supply device A due to a periodic change of the level of the high frequency power that is given from the second high frequency power supply device B to the load C.

(b) In the case where the difference between the period of the level change and the control period of the output control of the first high frequency power supply device A is a slight difference and the mean value of the high frequency power is calculated from the detection data obtained by detecting in each control period Tc the level of the high frequency power of which the level is changed in the power change period Tz, the number ns of detection data that are needed to correctly calculate the arithmetic mean value (true mean value) of the level change of one cycle of the high frequency power that is detected from the output side of the first high frequency power supply device A becomes extremely larger in comparison to the number n (n is predetermined) of detection data that are used to calculate the moving mean value in the high frequency power detection unit of the first high frequency power supply device A, and thus only the detection data for a part of the waveform of one period of the level change of the high frequency power can be included in the n detection data that are used to calculate the moving mean value through the corresponding high frequency power detection unit. Accordingly, a state where the moving mean value of the high frequency power that is detected by the high frequency power detection unit in each control period leans toward the upper side of the true mean value and a state where the moving mean value leans toward the lower side of the true mean value are repeated in the low frequency.

(c) As described above, if the state where the moving mean value of the high frequency power that is detected by the high frequency power detection unit of the first high frequency power supply unit A in each control period leans toward the upper side of the true mean value and the state where the moving mean value leans toward the lower side of the true mean value are repeated in the low frequency, a level change (fluctuation) of the low frequency occurs in the mean value of the output of the high frequency power generation unit of the first high frequency power supply device A.

(d) As described above, if the modulated frequency of the high frequency power that the second high frequency power supply device B gives to the load C is changed and the period of the level change of the high frequency power, which is detected from the output side of the high frequency power generation unit of the first high frequency power supply device A, is changed, the error between the moving mean value of the high frequency power that is detected by the high frequency power detection unit of the first high frequency power supply device A becomes greater, and thus the accuracy of the output control may deteriorate.

As the result of performing various experiments based on the above-described knowledge, the inventor found that if the control period was set to an appropriate value with respect to the period of the periodic level change (power change period) of the high frequency power detected from the output side of the high frequency power generation unit of the first high frequency power supply device A through a proper change of the control period in a range in which no influence was exerted on the power control, the difference between the control period and the power change period could be set to an appropriate size to prevent the fluctuation from occurring in the output due to the phenomenon that the moving mean value of the high frequency power detected by the high frequency power detection unit was changed to lean toward the upper side or the lower side of the true mean value and to prevent the accuracy of the output control from deteriorating due to the increase of the error between the moving mean value detected by the high frequency power detection unit and the true mean value.

Figure 8A:
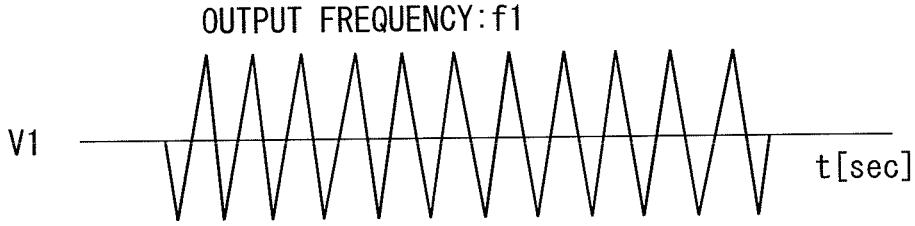
FIG. 8A is a waveform diagram schematically illustrating an example of a non-modulated waveform of a high frequency power output from a high frequency power supply device that is targeted for control and FIG. 8B is a waveform diagram schematically illustrating an example of a modulated waveform of a high frequency power given from another high frequency power supply device to a load.
Figure 8B:
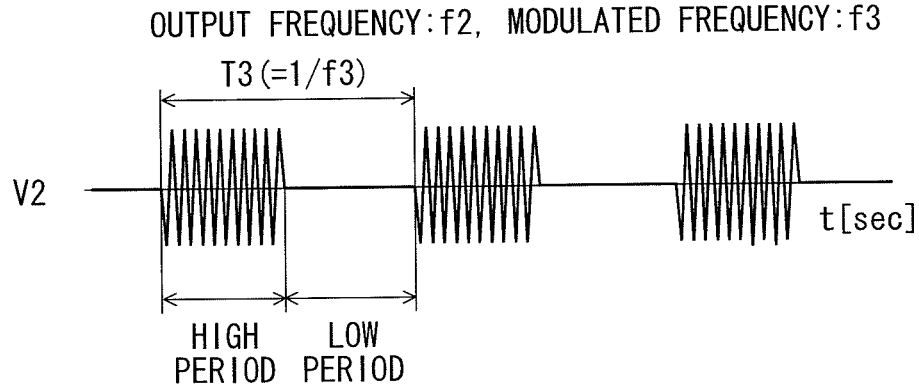

In the power supply system illustrated in FIG. 7, it is assumed that the high frequency power of the non-modulated consecutive voltage waveform, of which the mean value is constant, as illustrated in FIG. 8A is simultaneously supplied from the second high frequency power supply device B to the plasma load C to which the high frequency power of the pulse-modulated voltage waveform is supplied as illustrated in FIG. 8B. In this case, the high frequency voltage that the second high frequency power supply device B applies to the load C, as illustrated in FIG. 8B, has a waveform in which a "high" period and a "low" period are alternately repeated, and the levels of the high frequency power in the "high" period and in the "low" period differ from each other. In the case of supplying the pulse-modulated high frequency power to the load C such as the plasma load, the impedance of the load C is periodically changed according to the level change of the modulated high frequency power. Because of this, the impedance of the load, as seen from the output end of the high frequency power supply device A that generates the non-modulated high frequency power having a constant mean value, is periodically changed, and the levels of the traveling-wave power Pf and the reflection-wave power Pr which are detected from the output end of the high frequency power supply device A are periodically changed up and down the mean value. In this case, particularly, the reflection-wave power Pr shows a striking level change.

If the high frequency power that is given from the second high frequency power supply device B to the plasma load C is modulated by a pulse waveform, the waveform of the high frequency voltage V2 that is applied from the second high frequency power supply device B to the load C becomes, as illustrated in FIG. 8B, a waveform in which the envelope forms a rectangular shape. However, the waveform of the envelope of the actual high frequency voltage does not become a complete rectangular wave due to the relation with response delay and the like, but becomes a waveform that is near to a sine waveform. Under this influence, the changed waveform of the voltage level V1 of the traveling-wave power Pf and the reflection-wave power Pr detected from the output end of the high frequency power generation unit 4 of the first high frequency power supply device A becomes a waveform that is near to a sine waveform. Accordingly, in this embodiment, due to the influence of the modulated high frequency power that is given from another high frequency power supply device B to the load C, the levels of the traveling-wave power Pf and the reflection-wave power Pr which are detected from the output end of the high frequency power generation unit 4 form a waveform that is change in the form of a sine waveform up and down the true mean value Po.

As described above, the high frequency power detection unit 801 detects the level of the high frequency power that is targeted for detection in each detection timing that comes in each set control period Tc, obtains the moving mean value from the n (n is an integer that is equal to or larger than 2) detection data in the recent n detection timings, and detects the moving mean value as the mean value of the high frequency power that is targeted for detection.

The high frequency power detection unit 801 used in this embodiment also calculates the mean value of the effective power of the high frequency power that is targeted for control through subtraction of the mean value of the reflection-wave power Pr from the detected value of the detected traveling-wave power Pf as described above, and gives the calculated mean value of the effective power to the duty ratio calculation unit 802.

The duty ratio calculation unit 802 calculates the duty ratio of the PWM control of the inverter 202 of the high frequency power generation unit 4 as the operation amount so that the deviation between the mean value of the high frequency power that is targeted for control and is detected by the high frequency power detection unit 801 in each control period Tc and the power setting value becomes zero. The control signal output unit 803 gives the control signal to the high frequency power generation unit 4 at each control period Tc so that the operation amount of the high frequency power generation unit 4 becomes the operation amount calculated by the duty ratio calculation unit 802. Accordingly, the duty ration calculation unit 802 performs the control for keeping the output value (a mean value of a plurality of instantaneous values detected between the respective control period Tc) of the high frequency power (in this example, the effective power obtained by subtracting the reflection-wave power Pr from the traveling-wave power Pf) that is targeted for control.

The inventor performed experiments to simulate the state where the pulse-modulated high frequency power was supplied from another high frequency power supply device B to the load by connecting a pseudo signal generator 30 to an output port that outputs the traveling-wave power Pf' of the directional coupler 5 and a port that outputs the reflection-wave power Pr' and superimposing a pseudo signal of a sine waveform having the same frequency as the frequency of the pulse-modulated waveform of the high frequency power that is given from another high frequency power supply device B to the load C on the traveling-wave power Pf' and the reflection-wave power Pr' detected by the directional coupler 5. In the experiments, as the result of various examinations through finely changing the control period, it became clear that the fluctuation occurred in the mean value of the output of the high frequency power generation unit 4 in the case where there was a few difference between the control period Tc and the power level change period Tz. Hereinafter, the result of examination will be described in detail.

Figure 4:
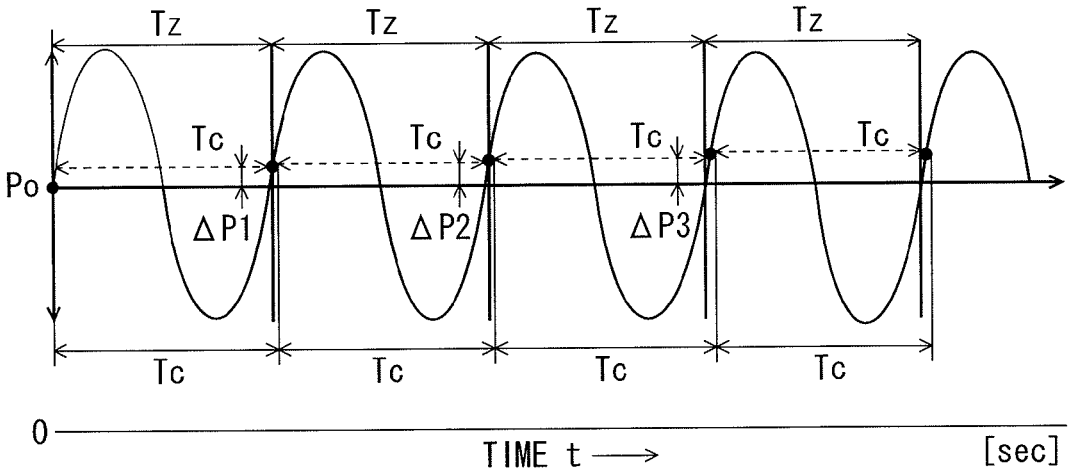
FIG. 4 is a waveform diagram that is used to explain a phenomenon that fluctuation occurs in a mean value of an output in the case where a level change of an output of another high frequency power supply device affects the high frequency power supply device.

In FIG. 4, it is assumed that the levels of the high frequency powers (in this embodiment, the traveling-wave power Pf' and the reflection-wave power Pr') that are targeted for detection are detected in each detection timing that comes whenever the control period Tc elapses, and the mean value (moving mean value) of the recent n (n is an integer that is equal to or larger than 2) detection timings including the latest detection data is detected as the mean value of the high frequency power that is targeted for detection. Further, normally, the detection data detected in the respective detection timings becomes the latest detection data, and in the case where the number n of detection data that are used to calculate the moving mean value and the number k of cycles that perform the calculation of the moving means are set sufficiently large, the detection data detected in the detection timing before one may be, for example, the latest detection data.

Here, as illustrated in FIG. 4, if it is assumed that the control period Tc is set to be slightly longer than the change period Tz (the same period as the period T3 of the modulated signal of the above-described frequency 13) of the power level (the difference between Tc and Tz is a slight difference), the detection timing is slightly shifted to the right as shown in FIG. 4 whenever the number of detections is repeated, and thus the difference ΔPx (=Px−Po, x=1, 2, 3, . . . , and n) between the level Px of the high frequency power that the high frequency power detection unit 801 detects at each detection timing and the mean value Po is slightly changed to lean toward the upper side of the mean value Po whenever the number of detections is repeated. In this case, since the number ns of detection data that are needed to detect the level change of one cycle becomes very large, that is, ns>>n, the detection data that are needed to correctly calculate the mean value of the high frequency power that is level-changed is not included in the n detection data that are used to calculate the moving mean value of the high frequency power.

In an example illustrated in FIG. 4, the moving mean value of the high frequency power is given as (P1+P2+ . . . +Pn)/n, and since the detection data P1, P2, . . . lean to the upper side of the true mean value Po, the calculated moving mean value Po' shows a larger value than the mean value Po. Since the phase for obtaining the n detection data that are used to calculate the moving mean value is shifted slowly in the right direction in FIG. 4 with the lapse of time, the value of the moving mean value Po' is also changed with the lapse of time. If the value is changed to certain point, the moving mean value Po' shows a value that leans toward the lower side of the true mean value Po.

By contrast, if the control period Tc is slightly shorter than the change period Tz of the power level, the difference between the level Px of the high frequency power that the high frequency power detection unit 801 detects at each detection timing and the mean value Po is changed to lean toward the lower side of the mean value Po whenever the number of detections is repeated. In this case, the detected mean value Po' of the high frequency power shows a value that is smaller than the true mean value Po. Even in this case, the mean value Po' actually detected increases or decreases slowly according to the detection timing and the change of the phase relationship with the high frequency power that is targeted for detection.

As described above, if the difference between the control period Tc and the power change period Tz is a slight difference, the calculated value of the moving mean value Po' is slowly changed up and down around the true mean value Po, and thus the output of the high frequency power generation unit 4 that is controlled based on the moving mean value Po' is changed slowly to cause the fluctuation to occur in the output.

Further, in the case of detecting the number n of detection data used to calculate the moving mean value and the level of the high frequency power of which the level is changed in the power change period Tz at each control period, if the difference with the number ns of data that are needed to obtain the arithmetic mean value of the high frequency power becomes larger, the error between the moving mean value and the true mean value Po becomes larger, and the accuracy of the output control for keeping the mean value of the output of the high frequency power generation unit 4 to the setting value deteriorates. In general, in the case where the difference between the control period Tc and m·Tz (m is an integer that is equal to or larger than 1) is a slight difference, the same problem occurs. Accordingly, it is needed to avoid causing a state where the difference between the control period Tc and the power change period m·Tz becomes a slight difference.

If the control period Tc is the same as the change period Tz, or Tc=m·Tz, the moving mean value Po' of the level of the high frequency power that the high frequency power detection unit 801 detects in each control period Tc shows approximately a constant value, and no fluctuation occurs in the output of the high frequency power generation unit 4. In this case, however, if the level detected in any detection timing has an error with respect to the true mean value Po, the detection data that includes the same error in the next detection timing is obtained. Accordingly, the calculated moving mean value also includes the error, and if the error is big, the control accuracy of the output of the high frequency power generation unit 4 is degraded. Accordingly, it is needed to avoid the setting of Tc=m·Tz.

According to the present invention, in order to prevent the occurrence of the above-described problem, the control period Tc is appropriately changed in a range that does not affect the control (in the range that does not spoil the stability of the control), and the control period Tc is set to an appropriate value with respect to the period of the level change (power change period) Tz of the high frequency power that is detected on the output side of the high frequency power generation unit 4. The phenomenon that the moving mean value Po' of the high frequency power that the high frequency power detection unit 801 detects in each control period shows the change that leans toward the upper side or lower side of the true mean value Po can be prevented although the true mean value Po of the high frequency power detected from the output end of the high frequency power generation unit 4 is constant, and thus the fluctuation is prevented from occurring in the output of the high frequency power generation unit 801.

Because of this, in this embodiment, the power change period detection unit 10 detecting the period of the level change of the traveling-wave power and (or) the reflection-wave power detected from the output side of the high frequency power generation unit 4 due to the periodic change of the level of the high frequency power given from another high frequency power supply device B to the load C from the traveling-wave power Pf' and (or) the reflection-wave power Pr' detected from the output side of the high frequency power generation unit 4 as the power change period Tz, and the control period setting means 11 for setting the control period Tc to an appropriate value according to the power change period Tz detected by the power change period detection unit 10 are installed. The timing controller 804 controls the timing in which the high frequency power detection unit 801 detects the high frequency power to set the control period Tc to the period set by the control period setting means 11 and the timing in which the control signal is given from the control signal output unit 803 to the high frequency power generation unit 4.

Further, one of the traveling-wave power Pf and the reflection-wave power Pr detected from the output end of the high frequency power supply device A, which is affected more greatly by the change of the impedance of the load, is the reflection-wave power Pr. Because of this, it is preferable that the power change period detection unit 10 is configured to detect the period Tz of the level change based on the reflection-wave power Pr' mainly detected through the directional coupler 5.

If the control period Tc is thoughtlessly changed, the control of the output of the high frequency power generation unit cannot be stably performed, and thus it is preferable that the control period setting means 11 is configured to set the appropriate value of the control period Tc within the range of the value taken by the control period Tc in the output control of the high frequency power generation unit 4.

In this embodiment, the high frequency power generation unit 4, the directional coupler 5, the control unit 8, the power change period detection unit 10, and the control period setting means 11 constitute the high frequency power supply device.

As described above, if the value of the control period Tc is set to an appropriate value with respect to the power change period Tz, the control period value can be set so as to prevent the occurrence of repetition of the state where the detected moving mean value shows a value that leans toward the upper side of the true mean value and the state where the moving mean value leans toward the lower side of the true mean value, and thus the fluctuation can be prevented from occurring in the output of the high frequency power generation device 4 that outputs the high frequency power having the consecutive waveform (non-modulated waveform). Further, since the control period Tc can be set to reduce the error between the moving mean value Po' and the true mean value Po, the accuracy of the output control is prevented from deteriorating.

As described above, if the difference between the control period Tc and the power change period Tz is a slight difference, the difference between the moving mean value detected by the high frequency power detection unit 801 and the true mean value becomes large, and the moving mean value is slowly changed up and down around the true mean value to cause the fluctuation to occur in the output. However, if the difference between the control period Tc and the power change period Tx is set to be somewhat large, the moving mean value can be calculated in the form that is near to the true mean value.

As an example, a case where one period of the power change period Tz is expressed by 0 to 100% and the control period Tc is lengthened by 10% with respect to the power change period Tz may be considered. In this case, the level P1 that is detected in the first control period is the level that is detected at a time (end time of the first control period Tc) when a certain power change period Tz is exceeded by 10%. Further, the level P1 that is detected in the second control period is the level that is detected at a time when the next power change period Tz is exceeded by 20%. Thereafter, in the same manner, the levels P3, . . . , P8, P9, and P10 are detected at times when the power change period Tz is exceeded by 30%, . . . , 80%, 90%, and 100%, respectively. In this case, since the moving mean value of the power, which is calculated in each detection timing, may take a value on the upper side or lower side with respect to the true mean value Po, the state where the detected moving mean value is changed slowly around the true mean value Po does not occur. In this case, if the level Px of the high frequency power is detected 10 times, the level Px is detected through the overall area of the power change period Tz, and thus the moving mean value of the high frequency power that is calculated in each detection timing approaches the true mean value Po.

By contrast, in the case where the control period Tc is shortened by 10% with respect to the power change period Tz, the level P1 that is detected in the first control period is the level that is detected at a time when a certain power change period Tz is exceeded by 90%. Further, the level P2 that is detected in the second control period is the level that is detected at a time when the next power change period Tz is exceeded by 80%. Thereafter, in the same manner, the levels Px are detected at times when the power change period Tz is exceeded by 70%, . . . , 30%, 10%, and 0%, respectively. In this case, in the same manner as the case where the control period Tc is lengthened by 10% with respect to the power change period Tz, the state where the detected level is changed up and down around the true mean value Po does not occur. Even in this case, if the level Px of the high frequency power that is targeted for detection is detected 10 times, the level Px is detected through the overall area of the power change period Tz, and thus the moving mean value of the high frequency power approaches the true mean value Po.

As described above, even in the case where the periodic level change occurs in the high frequency power, the moving mean value of the high frequency power can approximate the true mean value through the increase of the difference between the control period Tc and the power change period Tz to some extent. Accordingly, by setting the value of the control period Tc according to the power change period Tz so as to increase the difference between the control period Tc and the power change period Tz within a permissible range in performing the output control of the high frequency power generation unit 4, the fluctuation is prevented from occurring in the output of the high frequency power generation unit 4, and the accuracy of the output control is prevented from deteriorating. The appropriate value of the control period Tc can be calculated using a map for calculating the control period that gives the relationship between the power change period Tz and an appropriate value of the control period Tc. This map can be provided based on the results of experiments.

Further, as described hereinafter, the appropriate value of the control period Tc can be set by paying attention to the relationship between the number ns of detection data (the number of necessary data) that are needed to correctly calculate the arithmetic mean value and the number n (predetermined number) of detection data that are used to calculate the moving mean value or by paying attention to the relationship between the time ns×Tc that is needed to obtain the detection data the number of which is equal to the number ns of necessary data and the time n×Tc that is required to acquire n detection data used to calculate the moving mean value.

In order to calculate the true mean value through an arithmetic mean in the case where the mean value of the high frequency power is obtained from a detected value through detection of the level of the high frequency power at predetermined time intervals when the level of the high frequency power is periodically detected, it is needed to take the mean of the detection data obtained by detecting the overall change waveform of k (k is an integer that is equal to or larger than 1) cycles of the level change without irregularity. Even in the case of calculating the moving mean value of the high frequency power, in order to calculate the moving mean value as the value that is near to the true mean value, it is needed that the n detection data used for calculation are data obtained by detecting the levels of respective portions of the waveforms of the k cycles of the level change of the high frequency power to be detected without irregularity. In the case where the n detection data used to calculate the moving mean value includes only the detection data of a part of the waveform of one cycle of the level change waveform, some kind of errors occur between the moving mean value and the true mean value.

In the case of calculating the mean value of the high frequency power through detection of the level of the high frequency power, of which the level is change in the power change period Tz, in each control period Tc, the number ns of detection data (the number of necessary data) that are needed to acquire with respect to the waveform of the k cycles of the level change waveform to calculate the mean value through an arithmetic mean can be calculated by the following equation.

$$Ns=\{Tz/|m\cdot Tz-Tc|\} \quad (1)$$

Here, m is an integer that is equal to or larger than 1, and it is assumed that the following relationship is established between Tz and Tc.

$$mTz\neq Tc \quad (2)$$

Further, if the result of the calculation in the equation (1) is not integer, an appropriate fraction handling such as rounding off, close, and cutting off is performed.

In the equation (1), the reason why the power change period Tz that is a denominator is multiplied by m is that the same problem generally occurs if the difference between Tc and m·Tz is a slight difference.

In order to reduce the error between the moving mean value and the true mean value in the case of calculating the moving mean value of the high frequency power through detection of the level of the high frequency power, of which the level is changed in the power change period Tz, in each control period Tc, it is preferable that the number ns of necessary data calculated by the equation (1) coincides with the number n of detection data that are used to calculate the moving mean value (n=ns) or the difference between n and ns is as small as possible. Further, since the time that is required to calculate the moving mean value is n×Tc and the time that is required to obtain the ns detection data is ns×Tc, it is preferable that the control period is set so that the equation of n×Tc=ns×Tc is satisfied or the difference between n×Tc and ns×Tc becomes as small as possible in order to reduce the error between the moving mean value and the true mean value.

If ns>n(ns×Tc>n×Tc) is satisfied, data that is obtained by detecting level information of the waveform in one cycle of the level change of the high frequency power without irregularity is unable to be included in the n detection data used for the moving mean value, and thus the error between the moving mean value and the true mean value becomes bigger. Further, if ns<n(ns×Tc<n×Tc) is satisfied, data that is unnecessary to correctly calculate the mean value of the high frequency power is included data in the n detection data used for the moving mean value. Accordingly, in the same manner, the error between the moving mean value and the true mean value becomes bigger.

As is clear from the equation (1), in order to correctly calculate the mean value of the high frequency power, the number ns of necessary data that are needed to acquire with respect to the waveform of one cycle of the level change of the high frequency power (in the voltage change period Tz) becomes a function of the control period Tc and the power change period Tz, and thus the value of the control period that satisfies the equation of n×Tc=ns×Tc is changed according to the change of the value of the power change period Tz. Accordingly, in order to reduce the error between the moving mean value and the true mean value, it is needed to set the value of the control period Tc to an appropriate value according to the value of the power change period Tz. Further, the control period Tc affects the control characteristic of the output control to keep the mean value of the output of the high frequency power generation unit to the setting value, and thus it is needed to set the value of the control period Tc to a value within the permissible range of the output control.

From the above, the control period setting means 11 may be configured to set the control period Tc by the following ways of thinking.

(A) The control period setting means sets the value of the control period to an appropriate value that is a value in the range in which the error which occurs between the moving mean value of the high frequency power that is calculated using the n detection data and the true mean value of the high frequency power can be kept in the permissible range and the time that is needed to obtain the n detection data can be kept equal to or below the upper limit time that is permitted in controlling the high frequency power generation unit.

(B) The control period setting means sets an appropriate value of the control period according to the power change period detected by the power change period detection unit so that the high frequency power detection unit sets the time n×Tc that is required to obtain the recent n detection data that are used to calculate the moving mean value to the time in which the error that occurs between the moving mean value of the high frequency power calculated using the n detection data and the true mean value of the high frequency power can be kept within the permissible range.

(C) The control period setting means sets an appropriate value of the control period so that the high frequency power detection unit sets the time different ΔT (=Tcx|n−ns|) between the time n×Tc that is required to obtain the recent n detection data that are used to calculate the moving mean value and the time ns×Tc that is required to obtain ns detection data that are needed to calculate an arithmetic mean value of level change of k (k is an integer that is equal to or larger than 1) cycles of the high frequency power using the detection data that is obtained by detecting the level of the high frequency power, of which the level is changed in the power change period Tz (where, Tz≠Tc), in each control period Tc, to the time difference in the range in which the error that occurs between the moving mean value of the high frequency power calculated using the n detection data and the true mean value of the high frequency power can be kept within the permissible range.

(D) The control period setting means sets an appropriate value of the control period so that the high frequency power detection unit keeps the time different ΔT (=Tc×|n−ns|) between the time n×Tc that is required to obtain the recent n detection data that are used to calculate the moving mean value and the time ns×Tc that is required to obtain ns detection data that are needed to calculate the arithmetic mean value of level change of k (k is an integer that is equal to or larger than 1) cycles of the high frequency power using the detection data that is obtained by detecting the level of the high frequency power, of which the level is changed in the power change period Tz (where, Tz≠Tc), in each control period Tc, within the permissible range.

(E) The control period setting means sets an appropriate value of the control period so that the high frequency power detection unit minimizes the time different ΔT (=Tc×|n−ns|) between the time n×Tc that is required to obtain the recent n detection data that are used to calculate the moving mean value and the time ns×Tc that is required to obtain ns detection data that are needed to calculate the arithmetic mean value of level change of k (k is an integer that is equal to or larger than 1) cycles of the high frequency power using the detection data that is obtained by detecting the level of the high frequency power, of which the level is changed in the power change period Tz (where, Tz≠Tc), in each control period Tc.

According to the above-described aspects, if the appropriate value of the control period Tc is set with respect to the power change period Tz, the error between the moving mean value of the high frequency power detected by the high frequency power detection unit 801 and the true mean value can be decreased. Accordingly, the moving mean value of the detected high frequency power is changed to lean toward the upper side or lower side of the true average value, and thus the accuracy of the output control is prevented from deteriorating due to the fluctuation occurring in the output of the high frequency power generation unit or the increase of the error occurring between the moving means value detected by the high frequency power detection unit and the true mean value.

Further, the appropriate value of the control period Tc may be set to a value that minimizes an absolute value of a time integral value of a difference ΔPx between the level Px of the high frequency power that the high frequency power detection unit 801 detects at each detection timing and the true mean value Po of the high frequency power in a range that is predetermined not to affect the control of the high frequency power. Here, the time integral value of the difference ΔPx is a total value of differences ΔP1, ΔP2, . . . , and ΔPn between a series of detection data P1, P2, . . . , and Pn detected for a predetermined time T and the true mean value Po of the high frequency power. The difference is calculated in a manner that whether the detected level Px of the high frequency power is higher or lower than the true mean value Po is determined by the positive or negative mark of the difference.

If the control period Tc is set as described above, the moving mean value of the high frequency power detected by the high frequency power detection unit 801 is hardly affected by the level change of the high frequency power supplied from another high frequency power supply device B to the load C, and becomes approximately the same as the true mean value Po of the high frequency power detected from the output end of the high frequency power generation unit 4. Accordingly, it is restrained that the moving mean value of the high frequency power detected by the high frequency power detection unit 801 is affected by the level change of the high frequency power supplied from another high frequency power supply device B to the load C to cause the fluctuation.

It is preferable that the control period setting means 11 is configured to calculate the appropriate value of the control period that takes a value in the predetermined range so as not to cause trouble in the control of the high frequency power using a map for calculating the control period, which gives the relationship between the load change period Tz detected by the power change period detection unit 10 and the appropriate value of the control period Tc. The map for calculating the control period, which is used in this case can be provided based on the results of experiments to measure the variation amount of the output of the high frequency power generation unit while variously changing the control period of the output control with respect to the respective modulated frequency of the high frequency power that is output by another high frequency power supply device.

The state where the pulse-modulated high frequency power is supplied from another high frequency power supply device to the load can be simulated by superimposing the pseudo signal having the same frequency as the pulse-modulated waveform with the high frequency power on the output side of the high frequency power generation unit 4. For example, as illustrated in FIG. 2, the pseudo signal generator 30 is connected to the output port that outputs the traveling-wave power Pf' of the directional coupler 5 and the port that outputs the reflection-wave power Pr', and the pseudo signal having the same frequency as the frequency of the pulse-modulated waveform of the high frequency power that is given from another high frequency power supply device to the load is superimposed with the traveling-wave power Pf' and the reflection-wave power Pr' detected by the directional coupler 5 to perform the simulation.

As an example, it is exemplified that high frequency power of the consecutive waveform of 3.2 MHz is supplied to the plasma load C to which the pulse-modulated high frequency power of 60 MHz is given from another high frequency power supply device B. An experiment was performed to check the control characteristics through superimposition of the pseudo signal of a sine waveform having the same frequency as the pulse-modulated waveform of the high frequency power that is given from another high frequency power supply device to the load with the traveling-wave power Pf' and the reflection-wave power Pr' output from the directional coupler 5.

In the case of performing pulse modulation of the high frequency power of 60 MHz that is supplied from another high frequency power supply device B to the load C to generate the plasma on the plasma load C, the frequency of the pulse-modulated waveform is changed, for example, in the range of 10 kHz to 90 kHz. In the experiment performed this time, under the assumption that the frequencies of the pulse-modulated waveforms of the high frequency power of 60 MHz given from another high frequency power supply device to the load were set to 10 kHz, 40 kHz, and 70 kHz, the pseudo signal having these frequencies were injected to the port that outputs the traveling-wave power Pf' from the pseudo signal generator 30 and the port that outputs the reflection-wave power Pr', and the control was performed to keep the level of the high frequency power output from the high frequency power generation unit 4 to the setting value by changing the duty ratio by 50% at maximum when the output of the inverter 202 of the DC power supply unit 2 was PWM-controlled.

Figure 5A:
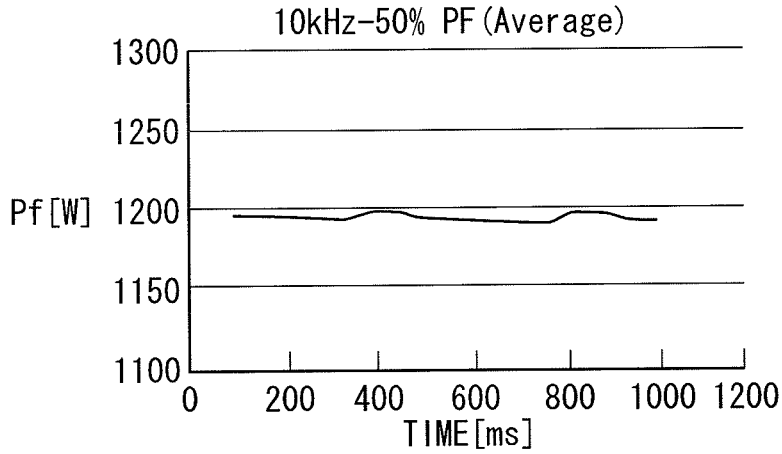
FIGS. 5A to 5C are graphs illustrating changes of output levels, which are observed in the case where simulated signals having different frequencies are input to the output side of the high frequency power supply device with the lapse of time in order to simulate a state where a level change of a pulse-modulated high frequency power that is given from another power supply device to a load affects the high frequency power supply device in the related art.
Figure 5B:
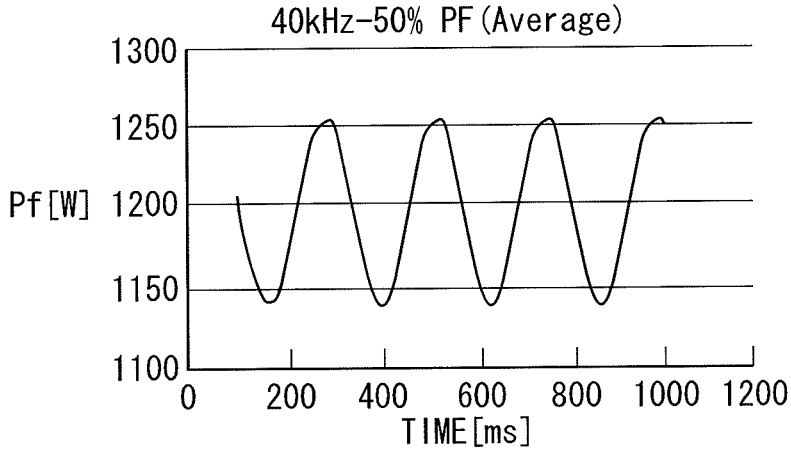
Figure 5C:
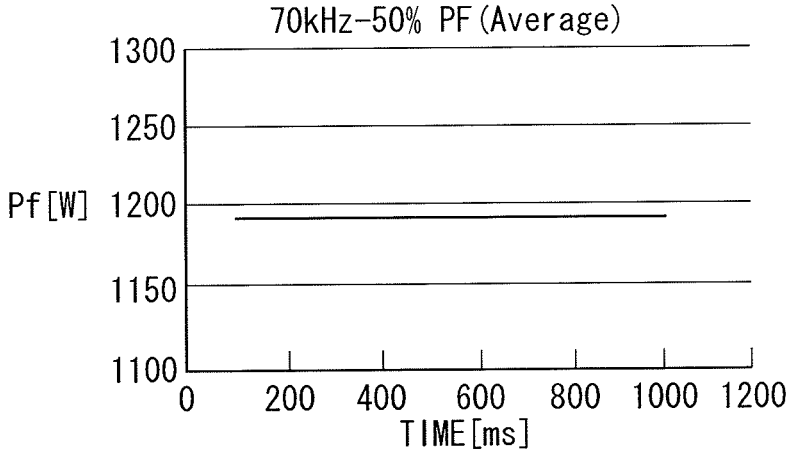

In the above-described experiment, the temporal change of the output level of the high frequency power generation unit 4 measured in the case where the frequencies of the pseudo signal were 10 kHz, 40 kHz, and 70 kHz is shown in FIGS. 5A to 5C. In the drawings, the vertical axis represents a power value [W], and the horizontal axis represents time [msec]. As is clear from the drawings, in the high frequency power supply device in the related art, if the pulse-modulated high frequency power is supplied from another high frequency power supply device to the load, it is affected by the pulse-modulated waveform, and the output level thereof fluctuates at a low frequency.

Figure 6A:
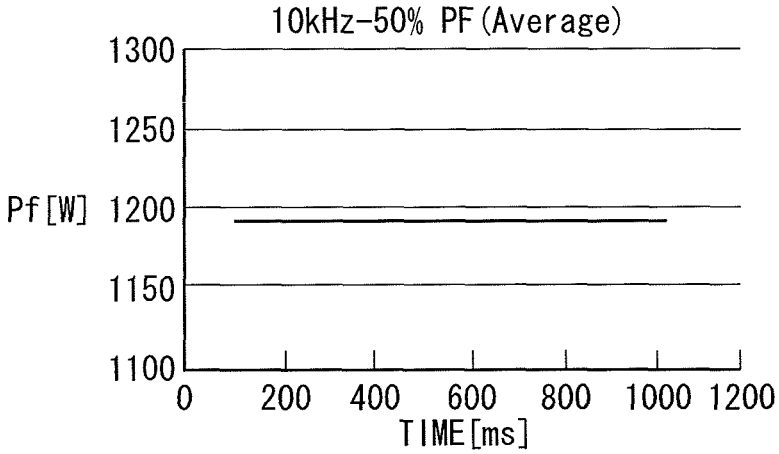
FIGS. 6A to 6C are graphs illustrating changes of output levels, which are observed in the case where simulated signals having different frequencies are input to the output side of the high frequency power supply device with the lapse of time in order to simulate a state where a level change of a pulse-modulated high frequency power that is given from another power supply device to a load affects the high frequency power supply device according to en embodiment of the present invention.
Figure 6B:
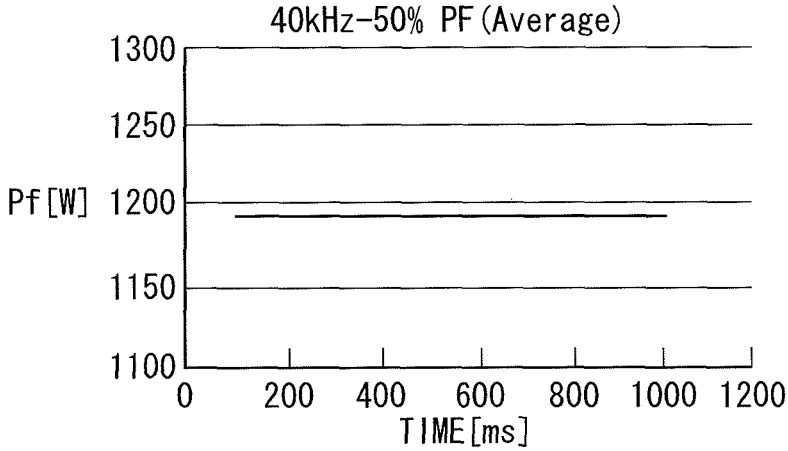
Figure 6C:
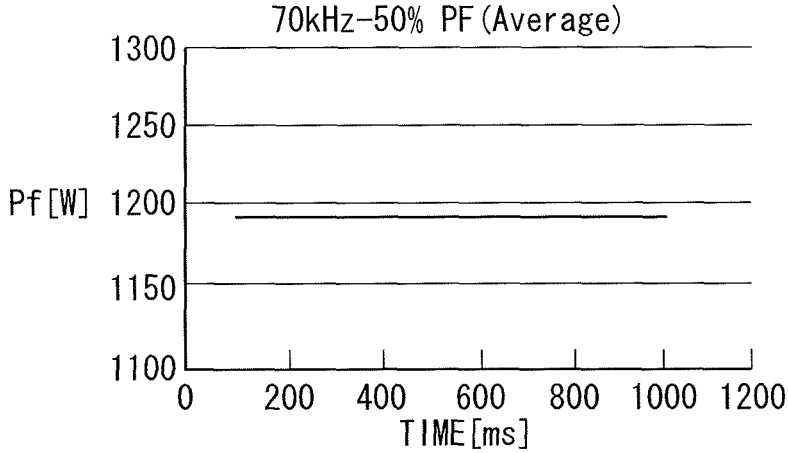

In the embodiment of the present invention, the same experiment as above was performed by setting the control period Tc sufficiently long with respect to the power change period Tz of the power level in the permissible range, so that the difference between the level (instantaneous value) Px of the high frequency power detected in each control period Tc and the true mean value Po did not lean to the upper side or lower side of the true mean value Po when the level change of the high frequency power detected on the output side of the high frequency power generation unit 4 was detected by the high frequency power detection unit 801. The temporal change of the output level of the high frequency power generation unit 4 observed in the case where the frequencies of the pseudo signal were set to 10 kHz, 40 kHz, and 70 kHz was as illustrated in FIGS. 6A to 6C.

As is clear from these results, according to the present invention, even if the high frequency power that is modulated by the pulse waveform or the like is supplied from another high frequency power supply device to the load, the mean value of the high frequency power output from the high frequency power generation unit 4 can be constantly maintained without being affected by the level change of the modulated waveform, and under the influence of the level change of the high frequency power that is given from another high frequency power supply device B to the load C, the low frequency fluctuation is prevented from occurring in the mean value of the output.

If the appropriate value of the control period Tc is not present in the permissible range for control, the control period setting means 11 is configured to change the control period Tc within the set range with the lapse of time, and thus the output change due to the change of the output of another high frequency power supply device B can be restrained.

By making the control period changed within the set range with the lapse of time in the case where the appropriate value of the control period is not present in the set range, the phase that detects the high frequency power is appropriately changed by the high frequency power detection unit 801, and the n detection data that the high frequency detection unit 801 uses to calculate the moving mean value can be prevented from being composed of a data group obtained by detecting only the levels of a specified part of level change waveforms of k cycles of the high frequency power. Accordingly, the error between the moving mean value detected by the high frequency power detection unit and the true mean value can be reduced.

In the above-described embodiment, the control to keep the level of the high frequency power output from the high frequency power generation unit 4 to the setting value is performed through control of the output voltage of the DC power supply unit 2. However, even in the case where the control to keep the level of the high frequency power output from the high frequency power generation unit 4 to the setting value is performed through control of the high frequency power amplification unit 3 with the output voltage of the DC power supply unit 2 kept constant, for example, even in the case where the control to keep the level of the high frequency power output from the high frequency power generation unit 4 to the setting value is performed through consideration of the gain of the high frequency power amplification unit 3*s* the operation amount, the present invention can be applied. Further, in the case of configuring the high frequency power generation unit 4 with a DDS (Direct Digital Synthesizer) that generates the high frequency signal having the same frequency and amplitude as commanded by a frequency command and an amplitude command and an amplifier that amplifies the output of the DDS, the output of the high frequency power generation unit 4 can be controlled in consideration of the amplitude command given to the DDS as the operation amount.

In the above-described description, in order to simulate the state where the high frequency power having a periodic level change is supplied from another high frequency power supply device B to the load, the pseudo signal is given to both the port that outputs the traveling-wave power Pf' of the directional coupler 5 and the port that outputs the reflection-wave power Pr'. However, the pseudo signal may be given to any one of the port that outputs the traveling-wave power Pf' of the directional coupler 5 and the port that outputs the reflection-wave power Pr', for example, only to the port that outputs the reflection-wave power Pr'.

In the above-described embodiment, only a control to keep the mean value of the high frequency power (traveling-wave power or effective power) to be controlled by the control unit 8 to the setting value is performed. However, the present invention can be applied to other controls, such as a control to limit the total value of the traveling-wave power and the reflection-wave power below a permissible upper limit value to protect a semiconductor devices constituting the power amplification unit, a loss reduction control with respect to the output of the DC power supply unit 2 so as to minimize the loss occurring in the power amplification unit 3, and the like.

What is claimed is:

1. A high frequency power supply device comprising:

a high frequency power generation unit configured to output a high frequency power to be supplied to a load; and a control unit configured to detect a mean value of the high frequency power that is targeted for control at an output side of the high frequency power generation unit, and to control the high frequency power generation unit so as to keep the detected mean value of the high frequency power to a setting value, wherein the control unit includes:

a high frequency power detection unit configured to obtain detection data of a level of the high frequency power, that is needed to be targeted for detection in order to obtain the high frequency power that is targeted for control at a timing that comes in each control period $T_C$ as a detection timing, to obtain a moving mean value of the high frequency power that is targeted for detection from n detection data obtained at recent n detection timings, where n is an integer that is equal to or larger than 2, and to detect the mean value of the high frequency power that is targeted for control by setting the moving mean value as a mean value of the high frequency power, that is targeted for detection;

an operation amount calculation unit configured to set a size of a variable for determining a level of the high frequency power output from the high frequency power generation unit as an operation amount of the high frequency power generation unit and to calculate the operation amount which is needed to keep the mean value of the high frequency power that is targeted for control and is detected by the high frequency power detection unit to the setting value; and a control signal output unit configured to output in the each control period a control signal to be given to the high frequency power generation unit in order to set the operation amount of the high frequency power generation unit to the operation amount that is calculated by the operation amount calculation unit, and wherein the high frequency power supply device further comprises:

a power change period detection unit configured to detect a period of a level change of the high frequency power that is detected at the output side of the high frequency power generation unit due to a periodic change of a level of a high frequency power that is given to the load from another high frequency power supply device as a power change period $T_Z$; and a control period setting unit configured to set the control period $T_C$ to an appropriate value in accordance with the power change period $T_Z$ detected by the power change period detection unit.

2. The high frequency power supply device according to claim 1, wherein the control period setting unit sets the appropriate value of the control period to a value within a range in which an error which occurs between the moving mean value of the high frequency power, that is calculated using the n detection data and a true mean value of the high frequency power can be kept within a permissible range and a time that is needed to obtain the n detection data can be kept equal to or below an upper limit time that is permitted in controlling the high frequency power generation unit.

3. The high frequency power supply device according to claim 1, wherein the control period setting unit sets the appropriate value of the control period in accordance with the power change period detected by the power change period detection unit so as to set a time n×Tc required for the high frequency power detection unit to obtain the recent n detection data to be used for calculating the moving mean value to a time in which an error which occurs between the moving mean value of the high frequency power, that is calculated using the n detection data and a true mean value of the high frequency power can be kept within a permissible range.

4. The high frequency power supply device according to claim 1, wherein the control period setting unit sets the appropriate value of the control period so as to set a time difference ΔT (=Tc×|n−ns|) between a time n×Tc required for the high frequency power detection unit to obtain the recent n detection data to be used for calculating the moving mean value and a time ns×Tc that is required for obtaining ns detection data that are needed to calculate an arithmetic mean value of level change of k cycles of the high frequency power using the detection data that is obtained by detecting, in the each control period $T_C$, the level of the high frequency power of which the level is changed in the power change period $T_Z$ to a time difference in a range in which an error that occurs between the moving mean value of the high frequency power calculated using the n detection data and a true mean value of the high frequency power can be kept within a permissible range, where k is an integer that is equal to or larger than 1 and where m·Tz≠Tc and m is an integer that is equal to or larger than 1.

5. The high frequency power supply device according to claim 4, wherein the number ns of the detection data that are needed to calculate the arithmetic mean value of the level change of the k cycles of the high frequency power is calculated by an equation ns=k×{Tz/|m·Tz−Tc|}, where.

6. The high frequency power supply device according to claim 1, wherein the control period setting unit sets the appropriate value of the control period so as to keep a time difference ΔT (=Tc×|n−ns|) between a time n×Tc required for the high frequency power detection unit to obtain the recent n detection data to be used for calculating the moving mean value and a time ns×Tc that is required for obtaining ns detection data that are needed to calculate an arithmetic mean value of level change of k cycles of the high frequency power using the detection data that is obtained by detecting, in the each control period $T_C$, the level of the high frequency power of which the level is changed in the power change period $T_Z$, within a permissible range, where k is an integer that is equal to or larger than 1 and where m·Tz≠Tc and m is an integer that is equal to or larger than 1.

7. The high frequency power supply device according to claim 6, wherein the number ns of the detection data that are needed to calculate the arithmetic mean value of the level change of the k cycles of the high frequency power is calculated by an equation ns=k×{Tz/|m·Tz−Tc|}, where.

8. The high frequency power supply device according to claim 1, wherein the control period setting unit sets the appropriate value of the control period so as to minimize a time difference ΔT (=Tc×|n−ns|) between a time n×Tc required for the high frequency power detection unit to obtain the recent n detection data to be used for calculating the moving mean value and a time ns×Tc that is required for obtaining ns detection data that are needed to calculate an arithmetic mean value of level change of k cycles of the high frequency power using the detection data that is obtained by detecting, in the each control period $T_C$, the level of the high frequency power of which the level is changed in the power change period $T_Z$, within a permissible range, where k is an integer that is equal to or larger than 1 and where m·Tz≠Tc and m is an integer that is equal to or larger than 1.

9. The high frequency power supply device according to claim 8, wherein the number ns of the detection data that are needed to calculate the arithmetic mean value of the level change of the k cycles of the high frequency power is calculated by an equation ns=k×{Tz/|m·Tz−Tc|}, where.

10. The high frequency power supply device according to claim 1, wherein the control period setting unit is configured to calculate the appropriate value of the control period using a map that gives a relationship between the detected power change period and the control period.

11. The high frequency power supply device according to claim 1, wherein the control period setting unit is configured to set the appropriate value of the control period within a range of values that can be taken by the control period in an output control of the high frequency power generation unit.

12. The high frequency power supply device according to claim 1, wherein the control period setting unit is configured to change the control period within a range of values that can be taken by the control period with the lapse of time if the appropriate value of the control period is not present within the range of values that can be taken by the control period.

* * * * *